US011661152B2

(12) United States Patent
Bickham

(10) Patent No.: US 11,661,152 B2
(45) Date of Patent: May 30, 2023

(54) ASSEMBLY FOR ANCHORING A SUBMERGED VESSEL

(71) Applicant: Michael Bickham, Paola, KS (US)

(72) Inventor: Michael Bickham, Paola, KS (US)

( * ) Notice: Subject to any disclaimer, the term of this patent is extended or adjusted under 35 U.S.C. 154(b) by 175 days.

(21) Appl. No.: 17/115,485

(22) Filed: Dec. 8, 2020

(65) Prior Publication Data

US 2021/0086871 A1 Mar. 25, 2021

Related U.S. Application Data

(60) Provisional application No. 62/953,286, filed on Dec. 24, 2019.

(51) Int. Cl.
*B63B 21/20* (2006.01)
*B63B 21/54* (2006.01)
*B63B 21/00* (2006.01)

(52) U.S. Cl.
CPC ..... *B63B 21/20* (2013.01); *B63B 21/54* (2013.01); *B63B 2021/001* (2013.01); *B63B 2021/203* (2013.01)

(58) Field of Classification Search
CPC ... B63B 21/20; B63B 21/54; B63B 2021/001; B63B 2021/203
See application file for complete search history.

(56) References Cited

U.S. PATENT DOCUMENTS 3,224,404 A * 12/1965 George ..... B63B 21/54 114/230.25
4,793,646 A * 12/1988 Michaud, Jr. ..... B63B 21/54 114/221 R
5,398,634 A * 3/1995 Eagan ..... F16G 11/14 114/221 R
5,634,421 A * 6/1997 Velarde ..... B63B 21/00 114/221 R
5,704,669 A * 1/1998 Clark ..... B25J 1/04 294/24
2012/0152161 A1* 6/2012 Stanley ..... B63B 21/54 114/230.1
2019/0263478 A1* 8/2019 Roller ..... B63B 21/54

FOREIGN PATENT DOCUMENTS

GB 2426965 A * 12/2006 ..... B63B 21/54
WO WO-2011060007 A1 * 5/2011 ..... B63B 21/04

* cited by examiner

*Primary Examiner* — Anthony D Wiest
(74) *Attorney, Agent, or Firm* — Barry Choobin; Patent 360

(57) ABSTRACT

Disclosed is an assembly for anchoring a submerged vehicle to a stationary object. The assembly includes a telescoping tube having a hollow inner tube and a hollow outer tube, each the inner tube and the outer tube having a proximal end and a distal end. The distal end of the inner tube slidably received within the outer tube through its proximal end. A snap button configured at the proximal end of the outer tube that can engage with a hole near the distal end of the inner tube for locking the movement of the inner tube within the outer tube. A rope having a first end and a second end, the first end of the rope attached to the inner tube near its proximal end. The second member passes through the eye of the spring hook and into the proximal end of the inner tube to form an anchoring loop. The second end of the rope exits the telescoping tube through the distal end of the outer tube and forms a boat hook loop.

4 Claims, 4 Drawing Sheets

ASSEMBLY FOR ANCHORING A SUBMERGED VESSEL

CROSS-REFERENCE TO RELATED APPLICATIONS

This application claims priority to the U.S. provisional patent application Ser. No. 62/953,286, filed on Dec. 24, 2019, which is incorporated herein by reference in its entirety.

FIELD OF INVENTION

The present invention relates to an assembly for anchoring a submerged object, more particularly, the present invention relates to an assembly for anchoring a boat.

BACKGROUND

Boats are generally docked by anchoring to a fixed structure. A need is always there for a versatile anchor system that may allow anchoring a boat to a variety of stationary objects. A need is there for an anchoring system that may allow anchoring a boat to a variety of stationary objects without a need for a person to enter the water for anchoring the boat. A need is there for an anchoring system that can be easily removed.

The term boat herein encompasses submerged vehicles of low capacity and includes dinghy, motorboats, kayak, rowboats, pontoon boats, inflatable boats, and like watercraft.

SUMMARY OF INVENTION

The principal object of the present invention is therefore directed to an assembly for anchoring a boat to a stationary object.

It is another object of the present invention that the assembly allows anchoring the boat to a variety of stationary objects.

It is still another object of the present invention that the assembly is quick and easy to engage and disengage.

It is yet another object of the present invention that the assembly is economical to manufacture.

Disclosed is an assembly for anchoring a submerged vehicle to a stationary object. The assembly includes a telescoping tube having a hollow inner tube and a hollow outer tube, each the inner tube and the outer tube having a proximal end and a distal end. The distal end of the inner tube slidably received within the outer tube through its proximal end, A snap button configured at the proximal end of the outer tube that can engage with a hole near the distal end of the inner tube for locking the movement of the inner tube within the outer tube. A rope having a first end and a second end, the first end of the rope attached to the inner tube near its proximal end. The second end of the rope passes through the eye of a spring hook and into the proximal end of the inner tube to form an anchoring loop. The second end of the rope exits the telescoping tube through the distal end of the outer tube and forms a boat hook loop.

These and other objects and advantages of the embodiments herein will become readily apparent from the following detailed description taken in conjunction with the accompanying drawings

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
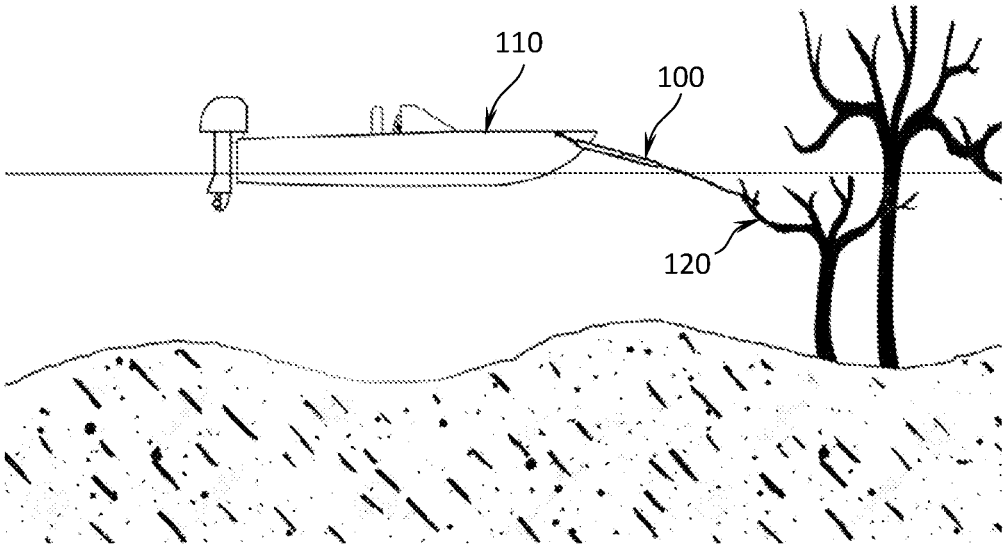
FIG. 1 shows the assembly anchoring a boat to an underwater branch of a tree, according to an exemplary embodiment of the present invention.
Figure 2:
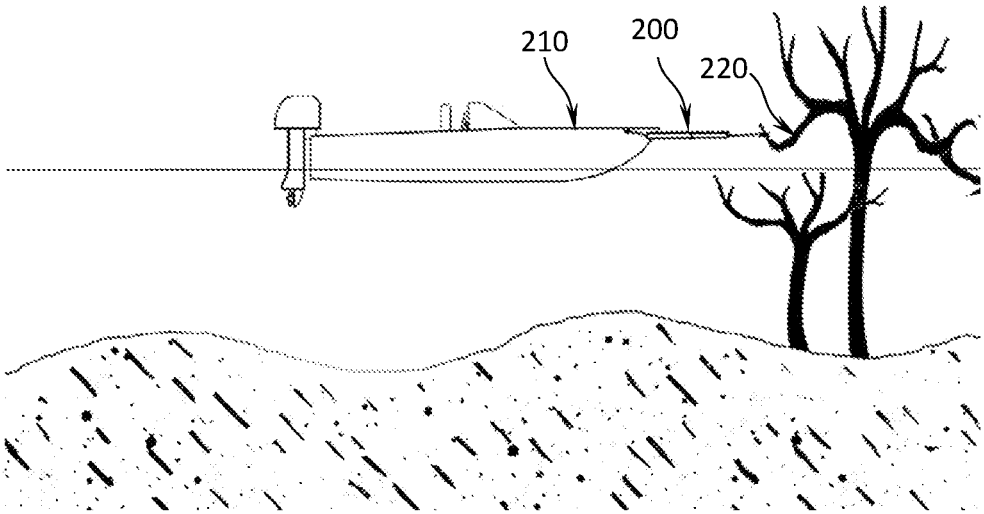
FIG. 2 shows the assembly anchoring a boat to a branch of a tree, according to the present invention.

Disclosed is an assembly for anchoring boats to a variety of stationary objects. The assembly is versatile and could be adjusted in length to reach a stationary object. For example, the stationary objects can be tree stumps, trees, limbs/branches above and below water level, another boat, dock boat cleat, or dock cleat. Additionally, the disclosed assembly may also allow a boat to anchor with another boat in waters or to a dock. For example, a boat in a lake could tie to a fallen tree. In one case, a fisherman fishing from a boat in a lake could tie his boat to a tree stump. Referring to FIG. 1, which shows an anchoring assembly 100 anchoring a boat 110 to an underwater stump 120. Referring to FIG. 2, which shows an assembly 200 anchoring the boat 210 to a branch 220 of a tree.

Figure 3:
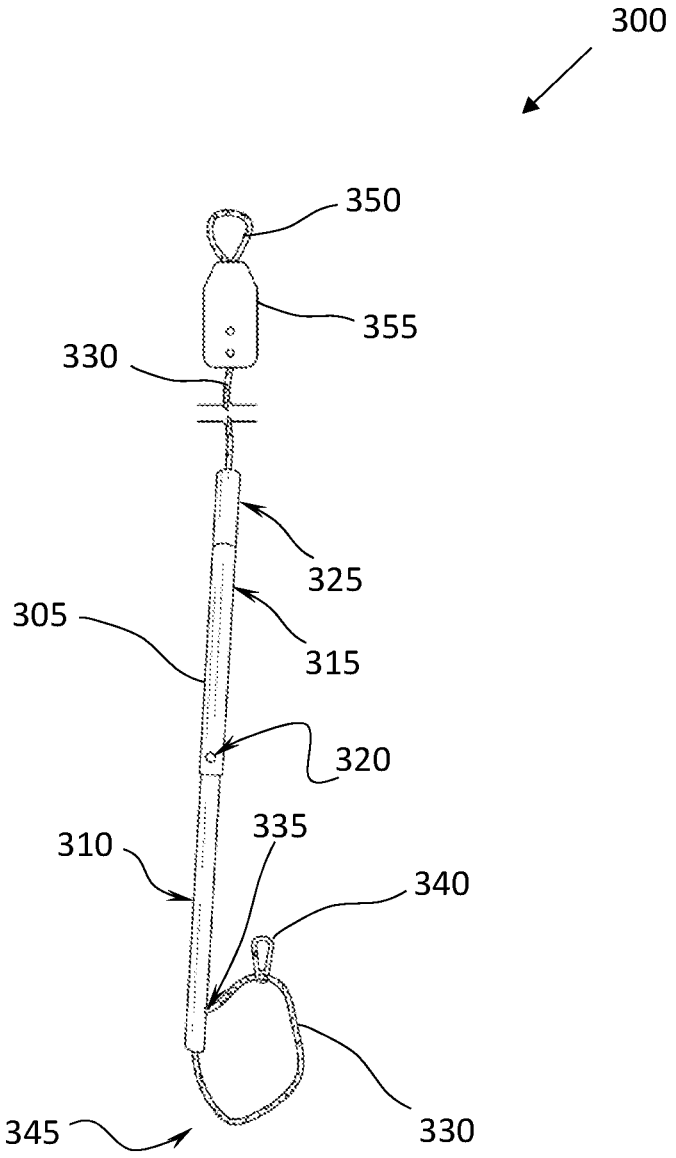
FIG. 3 is a perspective view of the assembly, according to an exemplary embodiment of the present invention.

Referring to FIG. 3 which shows a perspective view of the disclosed assembly 300 for anchoring a submerged vessel to a stationary object. The disclosed assembly includes a telescoping tube 305 having a hollow inner tube 310 and a hollow outer tube 315. Each of the inner tube and the outer tube having a proximal end and a distal end. The inner tube having a diameter less than the diameter of the outer tube, allowing the inner tube to be telescopically slidable within the outer tube. The distal end of the inner tube can slidably insert into the proximal end of the outer tube. Optionally, the proximal end of the outer tube can be configured with a sleeve glide while the distal end of the inner tube can be provided with a hollow plug. The sleeve glide and the hollow plug may provide slight tension for the smooth movement of the inner tube within the outer tube.

The proximal end of the outer tube can have a locking mechanism. The locking mechanism prevents the longitudinal movement of the outer tube relative to the inner tube. A user may adjust the length of the assembly by releasing the lock and moving the inner tube up and down within the outer tube. The locking mechanism can be a collar that is rotatable to compress the inner tube and the outer tube, binding them at a set length. The lock may also be a set screw bolt that passes through the outer tube and presses against the inner tube. The locking mechanism can also be snap button 320 at the proximal end of the outer tube 315, and one or more holes at the distal end of the inner tube. The snap button 320 can engage with one hole of the one or more holes.

The inner tube and outer tube may be cylindrical, rectangular, elliptical, or triangular elongated tubes. The inner tube and outer tube can be made of any rigid and durable materials including metal and plastic. For example, PVC and aluminum are light in weight and durable. In one implementation, the outer diameter of the inner tube can be about 1.3 inches and the outer diameter of the outer tube can be about 1.7 inches. In one implementation, each of the inner tube and the outer tube can be 24 inches, wherein the telescoping tube can extend up to 44 inches. The outer tube 315 can have a handgrip 325 at an end of the outer tube, i.e. distal end of the outer tube 315. The length of the fully extended telescoping tubes can be proportional to the minimum distance the boat is away from the stationary object. The telescoping tube prevents the boat from bumping into the stationary object.

Each end of the telescoping tube i.e. the distal end of the outer tube and the proximal end of the inner tube can be capped. Each cap on the opposite ends of the telescoping tubes can have an aperture for a rope 330 to slide in. Rope 330 can have a first end and a second end that is the other end of the rope. The first end of the rope 330 can be hooked to a point 335 near the capped end of the inner tube 310. The second end of the rope can then pass through an eye of a spring hook 340. The second end can then pass through the proximal end of the inner tube forming an anchor loop 345. The second end of rope 330 can insert into the aperture of the capped inner tube and exit through the capped end of the outer tube. The second end of the rope can then fix to a clamp 355 forming a boat hook loop 350.

Figure 5A:
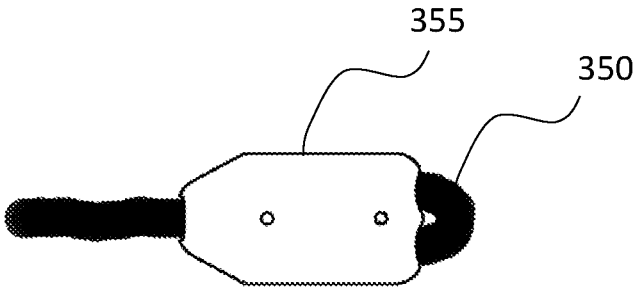
FIG. 5*a* shows the clamp and boat hook loop, according to an exemplary embodiment of the present invention.
Figure 5B:
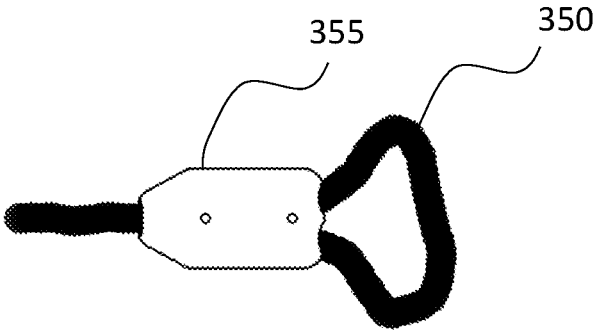
FIG. 5*b* shows the clamp and boat hook loop of FIG. 5*a* having the size of boat hook loop increased, according to an exemplary embodiment of the present invention.

Referring to FIGS. 5*a* and 5*b*, the clamp 355 is having a passage through which the second end passes through and then fixed to the clamp forming the boat hook loop 350. The rope 330 can slidably pass through the passage allowing the size of the loop 350 to be increased or decreased. FIG. 5*b* shows the loop with increased size compared to the loop shown in FIG. 5*a*.

Figure 4:
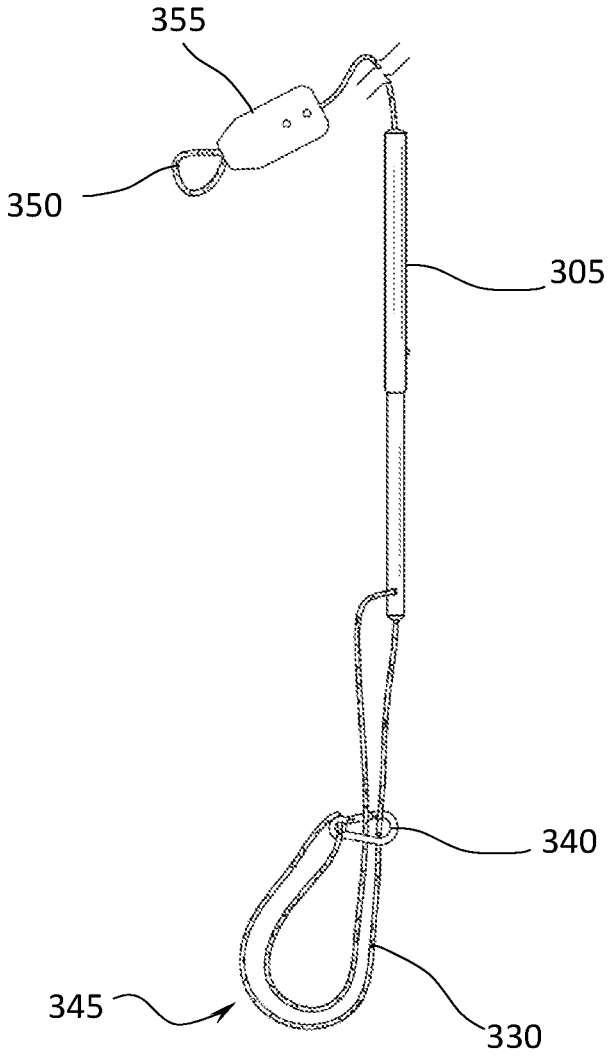
FIG. 4 shows a loop formed by a spring hook, according to an exemplary embodiment of the present invention.

The disclosed assembly 300 can be extended up to the desired length by pulling out the inner tube from the outer tube. The anchoring loop can then be anchored to a stationary object and then tighten by pulling the rope at its second end. The weight of the spring hook may allow the loop to sink in the water for anchoring to an underwater stationary object. FIG. 1 shows the anchoring loop secured to an underwater branch of a tree. The spring hook may also allow forming a stronger anchoring loop as shown in FIG. 4.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An assembly for anchoring a submerged vehicle to a stationary object, the assembly comprising:

a telescoping tube having a hollow inner tube and a hollow outer tube, each the inner tube and the outer tube having a proximal end and a distal end, the distal end of the inner tube slidably received within the outer tube through its proximal end;

a locking mechanism configured at the proximal end of the outer tube, the locking mechanism configured to lock the movement of the inner tube within the outer tube;

a spring hook having an eye; and a rope having a first end and a second end, the first end of the rope hooked to the inner tube near the proximal end of the inner tube, the second end passes through the eye of the spring hook into the proximal end of the inner tube to form an anchoring loop, the second end of the rope exits the telescoping tube through the distal end of the outer tube, the second end forms a boat hook loop, wherein the rope is slidably received within the telescoping tube, the second end is configured to be pulled to decrease a size of the anchoring loop, wherein the assembly further comprises a clamp, the clamp has a passage, the second end of the rope exits out of the distal end of the outer tube and then goes into the clamp passage and through the clamp and then hooks back to the clamp to form the boat hook loop, wherein the clamp is separate from the telescoping tube, wherein a weight of the spring hook permits the anchor loop to sink in the water for anchoring to an underwater stationary object.

2. The assembly according to claim 1, wherein each opposite end of the telescoping tubes is capped by a cap, the cap having an aperture for the rope to pass through.

3. The assembly according to claim 1, wherein the locking mechanism comprises a snap button, the snap button configured to engage with a hole in the inner tube near its distal end.

4. The assembly according to claim 1, wherein the assembly further comprises a handgrip configured on an outer surface of the outer tube.

* * * * *